United States Patent [19]

Waid et al.

[11] 4,189,333

[45] Feb. 19, 1980

[54] WELDED ALLOY CASING

[75] Inventors: George M. Waid, Burton; Anthony T. Davenport, Shaker Heights, both of Ohio

[73] Assignee: Republic Steel Corporation, Cleveland, Ohio

[21] Appl. No.: 868,261

[22] Filed: Jan. 9, 1978

[51] Int. Cl.[2] ..... C22C 38/06

[52] U.S. Cl. ..... 148/36; 75/124; 138/177; 148/127

[58] Field of Search ..... 148/36, 127, 12 F; 75/124, 125; 78/126 D, 126 E, 126 F, 126 K; 138/177

[56] References Cited

U.S. PATENT DOCUMENTS

| | | | |
|---|---|---|---|
| 2,845,345 | 7/1958 | Bauscher, Jr. et al. | 75/124 |
| 3,110,635 | 11/1963 | Gulya | 148/36 |
| 3,348,981 | 10/1967 | Goda et al. | 75/124 |
| 3,556,877 | 3/1968 | Ujiie | 148/127 |
| 3,656,917 | 4/1972 | Kikkawa et al. | 148/36 |
| 3,692,514 | 9/1972 | Hydrean | 75/124 |
| 3,725,049 | 4/1973 | Satoh et al. | 75/124 |
| 3,997,374 | 12/1976 | Dill et al. | 148/127 |
| 4,019,930 | 4/1977 | Aylward | 148/36 |
| 4,025,368 | 5/1977 | Sanbongi et al. | 148/36 |

*Primary Examiner*—Arthur J. Steiner

*Attorney, Agent, or Firm*—Watts, Hoffmann, Fisher & Heinke Co.

[57] ABSTRACT

A welded tubular steel product having a high ultimate tensile strength of at least 95 ksi and a relatively low yield strength in a range of from 55 to 80 ksi is made by alloying a plain carbon-manganese steel solely with chromium.

2 Claims, 6 Drawing Figures

VANADIUM STEEL, AS WELDED PIPE, 0.380-INCH WALL THICKNESS

VANADIUM STEEL, AS WELDED PIPE, 0.480-INCH WALL THICKNESS

CHROMIUM STEEL, AS WELDED PIPE, 0.380-INCH WALL THICKNESS

CHROMIUM STEEL, AS WELDED PIPE, 0.480 INCH WALL THICKNESS

WELDED ALLOY CASING

BACKGROUND OF THE INVENTION

The present invention relates generally to welded tubular steel products, and more specifically to the production of electrical resistance welded alloy casing characterized by a high ultimate tensile strength and a yield strength comparable to that of plain carbon-manganese steels currently used.

A typical carbon-manganese steel consists essentially of about 0.33% carbon, 1.32% manganese, 0.30% silicon and the balance iron. These conventionally used steels require high normalizing temperatures of from 1700° to 1750° F. in order to approach minimum tensile strength requirements of about 95 ksi. Even when normalized at high temperatures, it has been difficult consistently to meet minimum tensile strength requirements in casing having wall thicknesses of about ⅜ inch and greater.

Attempts have been made to improve the tensile strength of carbon-manganese steels by alloying them with a number of elements such as molybdenum, vanadium, chromium, nickel, columbium, titanium and zirconium in varying amounts. In many instances, the higher tensile strengths of the alloyed steels were accompanied by increased yield strengths and inferior welding properties. It has also been found that the desired minimum strength requirement of 95 ksi could not be consistently attained in some of the alloyed steels when normalized at temperatures below about 1700° F., this being particularly true in casing having wall thicknesses of about ⅜ inch or greater.

SUMMARY OF THE INVENTION

A purpose of the present invention is to provide a new alloy steel having a relatively low yield strength compared to its ultimate tensile strength, whereby the steel is suitable for making high strength, electrical resistance welded tubular products. A more specific purpose of the invention is to provide a welded alloy steel casing having an ultimate tensile strength in excess of 95 ksi and a relatively low yield strength in a range of from about 55 to 80 ksi.

It has been found that the tensile strength of plain carbon-manganese casing steel can be increased to a level in excess of 95 ksi without appreciably increasing the yield strength by alloying the steel solely with chromium in an amount of from about 0.20 to 1.00%. The yield strength to ultimate tensile strength ratio of the new steel is lower than that of the conventional plain carbon-manganese steels, this being especially true in the case of wall sections having a thickness of ⅜ inch or greater. As distinguished from previously proposed alloy casing steels, the new steel of the invention can be normalized at temperatures below 1700° F., e.g., about 1450° F., to obtain consistently high tensile strengths.

The invention provides a new, normalized welded tubular product formed of a steel consisting essentially of the following elements in amounts by weight based on the total weight of the steel: from 0.20 to 0.40% carbon, from 1.00 to 1.75% manganese, from 0.15 to 0.50% silicon, from 0.20 to 1.00% chromium, from 0.01 to 0.05% aluminum, and the balance iron except for normal residual constituents resulting from ordinary steel making practices. The new steel is further characterized by a high tensile strength of at least 95 ksi and a relatively low yield strength in a range of from about 55 to 80 ksi.

In a more preferred embodiment of the invention, the new welded tubular steel casing consists essentially of from 0.25 to 0.30% carbon, from 1.25 to 1.50% manganese, from 0.20 to 0.35% silicon, from 0.40 to 0.60% chromium, from 0.01 to 0.05% aluminum and the balance iron except for the normal residual constituents.

The invention further provides a method of making a welded tubular product comprising the steps of providing a steel consisting essentially of from 0.20 to 40% carbon, from 1.00 to 1.75% manganese, from 0.15 to 0.50% silicon, from 0.20 to 1.00% chromium, from 0.01 to 0.05% aluminum and the balance iron except for normal residual constituents; rolling and welding the steel into tubular form; and normalizing to obtain a yield strength of from about 55 to 80 ksi and an ultimate tensile strength of at least 95 ksi.

Other features and a fuller understanding of the invention will be had from the accompanying drawings and the following detailed description.

DESCRIPTION OF PREFERRED EMBODIMENTS

Figure 1:
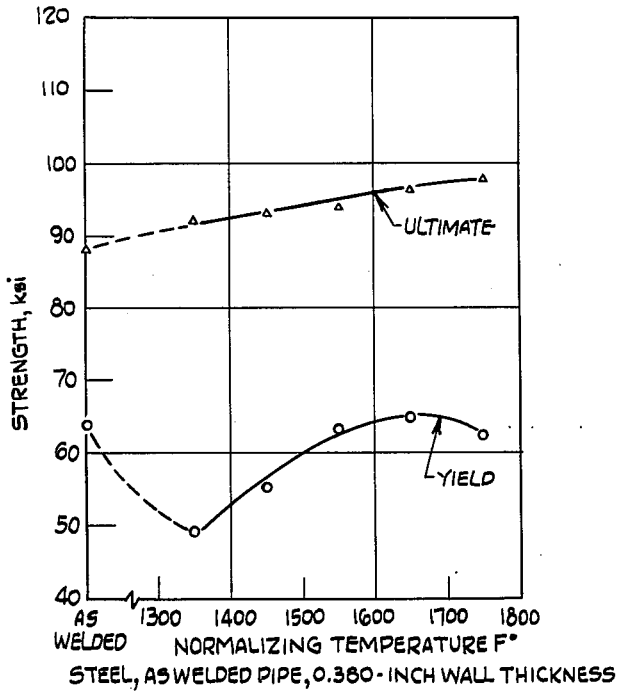
FIGS. 1 and 2 are graphs showing the yield and ultimate tensile strengths of a conventional carbon-manganese steel casing of two different wall sections normalized at varying temperatures.
Figure 2:
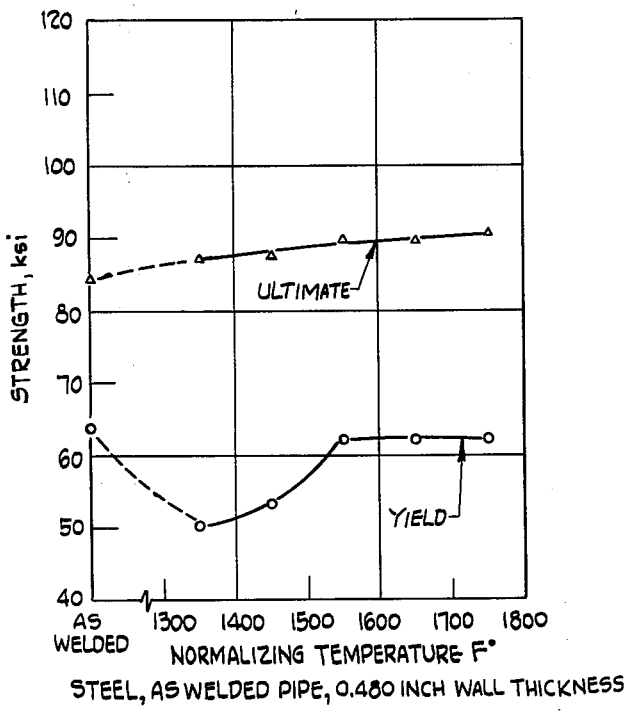
Figure 3:
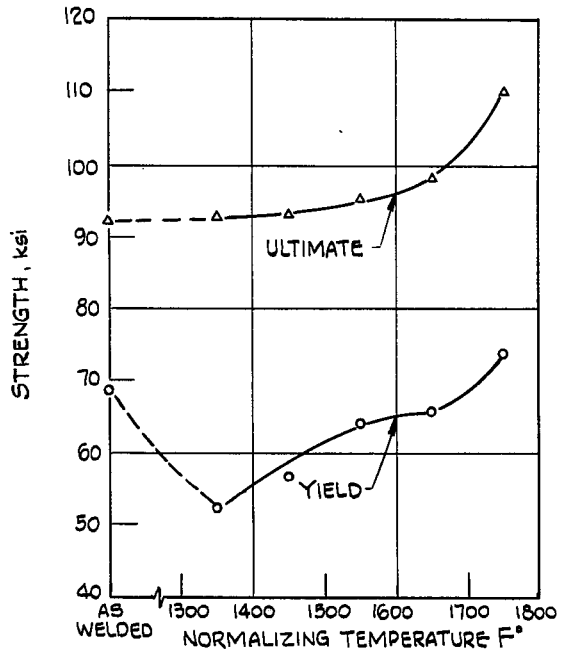
FIGS. 3 and 4 are graphs showing the yield and ultimate tensile strengths of a vanadium alloyed steel casing of two different wall sections normalized at varying temperatures.
Figure 4:
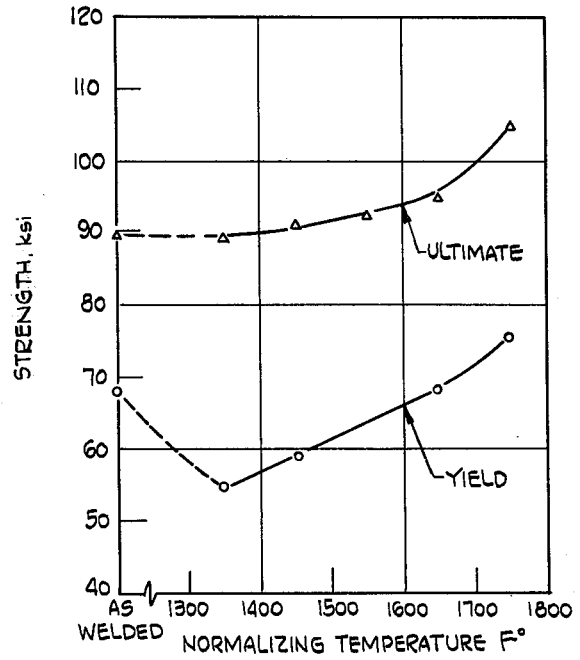

Investigations were conducted on three heats of steel to evaluate the effects of alloying elements and normalizing temperatures in meeting the high strength requirements of as-welded casing, i.e., an ultimate tensile strength of at least 95 ksi and a yield strength in a range of from about 55 to 80 ksi. One heat was a carbon-manganese steel of a type conventionally used in making electrical resistance welded casing, the second was a vanadium-containing steel, and the third was a chromium-containing steel according to the present invention.

As hereinafter described in greater detail, it was necessary to normalize the carbon manganese steel casing at a temperature above 1550° F. in order to meet the minimum tensile strength requirement in a 0.380 inch wall section. The minimum ultimate tensile strength requirements could not be achieved in heavier sections of 0.480 inches or greater even when normalized at temperatures of 1750° F.

The vanadium-containing steel was found to have little or no advantages over the carbon-manganese steel. It was necessary to heat treat the steel to temperatures above 1550° F. in order to meet the minimum strength requirements.

The chromium alloyed steel in the as-welded pipe condition exceeded all of the minimum strength requirements even in the thicker wall sections. At the same time, the yield strength was maintained in the desired range of from 55 to 80 ksi. and at a level below the yield strength of the vanadium alloyed steel casing. The resulting product was characterized by a yield to ultimate tensile strength ratio less than that of the plain carbon-manganese steel. The improved mechanical properties were obtained in all wall sections at a relatively low normalizing temperature of about 1450° F.

The chemical compositions of casing made from three heats of steel which were the subject of the investigation are set forth in Table I. The test results indicating the effects of normalizing temperature on mechanical properties of casing processed in walls sections of 0.380 and 0.480 inches are presented Tables II through VII and shown graphically in FIGS. 1 through 6.

TABLE I

CHEMICAL COMPOSITIONS OF CASING MATERIALS

| Heat | Type | C | Mn | Si | P | S | Al | Cu | Ni | Cr | V |
|---|---|---|---|---|---|---|---|---|---|---|---|
| 4497226 | C—Mn | 0.33 | 1.32 | 0.30 | 0.015 | 0.024 | 0.021 | 0.02 | 0.02 | 0.03 | <0.01 |
| 4423718 | Vanadium | 0.33 | 1.33 | 0.26 | 0.010 | 0.026 | <0.01 | 0.02 | 0.02 | 0.02 | 0.084 |
| 4423927 | Chromium | 0.28 | 1.43 | 0.32 | 0.010 | 0.018 | 0.019 | 0.03 | 0.03 | 0.51 | <0.01 |

TABLE II

MECHANICAL PROPERTIES OF WELDED AND NORMALIZED C-Mn STEEL (HEAT 4497226, 0.380-INCH WALL THICKNESS

| Sample No. | Yield Strength, ksi | Ultimate Tensile Strength, ksi | Y.S. U.T.S. | Elongation, % in 2 in. | Heat Treatment |
|---|---|---|---|---|---|
| S3-380-11 | 64.5 | 88.2 | | 25.0 | As-Welded |
| S3-380-12 | 63.8 | 88.2 | | 25.0 | As-Welded |
| Average | 64.2 | 88.2 | .728 | 25.0 | |
| S3-380-1 | 47.9 | 91.3 | | 29.5 | Normalized 1350 F for 30 Min., A.C. |
| S3-380-2 | 49.6 | 92.2 | | 28.0 | Normalized 1350 F for 30 Min., A.C. |
| Average | 48.8 | 91.8 | .532 | 28.8 | |
| S3-380-3 | 55.3 | 93.3 | | 29.5 | Normalized 1450 F for 30 Min., A.C. |
| S3-380-4 | 55.3 | 92.4 | | 29.5 | Normalized 1450 F for 30 Min., A.C. |
| Average | 55.3 | 92.9 | .595 | 29.5 | |
| S3-380-5 | 61.6 | 94.5 | | 29.0 | Normalized 1550 F for 30 Min., A.C. |
| S3-380-6 | 64.9 | 96.0 | | 29.0 | Normalized 1550 F for 30 Min., |
| Average | | | | | |
| Average | 63.3 | 95.3 | .664 | 29.0 | |
| S3-380-7 | 64.8 | 96.0 | | 30.0 | Normalized 1650 F for 30 Min., A.C. |
| S3-380-8 | 64.9 | 96.5 | | 29.0 | Normalized 1650 F for 30 Min., A.C. |
| Average | 64.9 | 96.3 | .674 | 29.5 | |
| S3-380-9 | 62.6 | 97.8 | | 29.0 | Normalized 1750 F for 30 Min., A.C. |
| S3-380-10 | 62.2 | 97.5 | | 29.0 | Normalized 1750 F for 30 Min., A.C. |
| Average | 62.4 | 97.7 | .639 | 29.0 | |

TABLE III

MECHANICAL PROPERTIES OF WELDED AND NORMALIZED C-Mn STEEL (HEAT 4497226, 0.480-INCH WALL THICKNESS)

| Sample No. | Yield Strength, ksi | Ultimate Tensile Strength, ksi | Y.S. U.T.S. | Elongation, % in 2 in. | Heat Treatment |
|---|---|---|---|---|---|
| S6-480-11 | 63.0 | 84.1 | | 26.5 | As-Welded |
| S6-480-12 | 64.0 | 84.0 | | 26.5 | As-Welded |
| Average | 63.5 | 84.1 | .755 | 26.5 | |
| S6-480-1 | 50.3 | 87.3 | | 29.5 | Normalized 1350 F for 30 Min., A.C. |
| S6-480-2 | 49.8 | 86.3 | | 31.0 | Normalized 1350 F for 30 Min.; A.C. |
| Average | 50.1 | 86.8 | .577 | 30.3 | |
| S6-480-3 | 53.1 | 87.5 | | 32.0 | Normalized 1450 F for 30 Min., A.C. |
| S6-480-4 | 53.1 | 86.9 | | 32.0 | Normalized 1450 F for 30 Min., A.C. |
| Average | 53.1 | 87.2 | .609 | 32.0 | |
| S6-480-5 | 61.4 | 89.4 | | 31.5 | Normalized 1550 F for 30 Min., A.C. |
| S6-480-6 | 62.2 | 90.0 | | 31.0 | Normalized 1550 F for 30 Min., A.C. |
| Average | 61.8 | 89.7 | .689 | 31.3 | |
| S6-480-7 | 62.5 | 89.5 | | 32.0 | Normalized 1650 F for 30 Min., A.C. |
| S6-480-8 | 61.1 | 89.2 | | 31.5 | Normalized 1650 F for 30 Min., A.C. |
| Average | 61.8 | 89.4 | .691 | 31.8 | |
| S6-480-9 | 62.5 | 90.5 | | 31.5 | Normalized 1750 F for 30 Min., A.C. |
| S6-480-10 | 62.0 | 90.4 | | 31.5 | Normalized 1750 F for 30 Min., A.C |
| Average | 62.3 | 90.5 | .688 | 31.5 | |

TABLE IV

MECHANICAL PROPERTIES OF WELDED AND NORMALIZED VANADIUM STEEL (HEAT 4423718, 0.380-INCH WALL THICKNESS)

| Sample No. | Yield Strength, ksi | Ultimate Tensile Strength, ksi | Y.S. U.T.S. | Elongation, % in 2 in. | Heat Treatment |
|---|---|---|---|---|---|
| V5-380-11 | 68.2 | 92.0 | | 23.5 | As-Welded |
| V5-380-12 | 68.6 | 91.9 | | 25.0 | As-Welded |
| Average | 68.4 | 92.0 | .743 | 24.3 | |
| V5-380-1 | 52.8 | 93.1 | | 28.0 | Normalized 1350 F for 30 Min., A.C. |
| V5-380-2 | 51.5 | 92.2 | | 29.0 | Normalized 1350 F for 30 Min., A.C. |
| Average | 52.2 | 92.7 | .563 | 28.5 | |
| V5-380-3 | 56.5 | 92.7 | | 30.5 | Normalized 1450 F for 30 Min., A.C. |
| V5-380-4 | 56.6 | 93.0 | | 30.0 | Normalized 1450 F for 30 Min., A.C. |
| Average | 56.6 | 92.9 | .609 | 30.3 | |
| V5-380-5 | 65.1 | 96.2 | | 28.5 | Normalized 1550 F for 30 Min., A.C. |
| V5-380-6 | 63.0 | 94.3 | | 29.5 | Normalized 1550 F for 30 Min., A.C. |
| Average | 64.1 | 95.3 | .673 | 29.0 | |
| V5-380-7 | 65.6 | 97.7 | | 28.5 | Normalized 1650 F for 30 Min., A.C. |
| V5-380-8 | 65.6 | 98.0 | | 28.5 | Normalized 1650 F for 30 Min., A.C. |
| Average | 65.6 | 97.9 | .670 | 28.5 | |
| V5-380-9 | 73.8 | 110.3 | | 25.0 | Normalized 1750 F for 30 Min., A.C. |
| V5-380-10 | 73.2 | 109.9 | | 24.0 | Normalized 1750 F for 30 Min., A.C. |
| Average | 73.5 | 110.1 | .668 | 24.5 | |

TABLE V

MECHANICAL PROPERTIES OF WELDED AND NORMALIZED VANADIUM STEEL (HEAT 4423718, 0.480-INCH WALL THICKNESS)

| Sample No. | Yield Strength, ksi | Ultimate Tensile Strength, ksi | Y.S. U.T.S. | Elongation, % in 2 in. | Heat Treatment |
|---|---|---|---|---|---|
| V4-480-11 | 68.6 | 89.7 | | 25.0 | As-Welded |
| V4-480-12 | 68.8 | 89.6 | | 25.0 | As-Welded |
| Average | 68.7 | 89.7 | .766 | 25.0 | |
| V4-480-1 | 55.1 | 89.7 | | 29.5 | Normalized 1350 F for 30 Min., A.C. |
| V4-480-2 | 54.0 | 88.8 | | 29.5 | Normalized 1350 F for 30 Min., A.C. |
| Average | 54.6 | 89.3 | .611 | 29.5 | |
| V4-480-3 | 58.9 | 91.1 | | 30.5 | Normalized 1450 F for 30 Min., A.C. |
| V4-480-4 | 58.5 | 91.2 | | 30.5 | Normalized 1450 F for 30 Min., A.C. |
| Average | 58.7 | 91.2 | .644 | 30.5 | |
| V4-480-5 | 64.4 | 92.3 | | 30.5 | Normalized 1550 F for 30 Min., A.C. |
| V4-480-6 | 64.3 | 92.4 | | 31.0 | Normalized 1550 F for 30 Min., A.C. |
| Average | 64.4 | 92.4 | .697 | 30.8 | |
| V4-480-7 | 66.7 | 94.0 | | 29.5 | Normalized 1650 F for 30 Min., A.C. |
| V4-480-8 | 68.9 | 95.9 | | 29.5 | Normalized 1650 F for 30 Min., A.C. |
| Average | 67.8 | 95.0 | .714 | 29.5 | |
| V4-480-9 | 75.2 | 104.2 | | 27.0 | Normalized 1750 F for 30 Min., A.C. |
| V4-480-10 | 75.0 | 105.4 | | 26.0 | Normalized 1750 F for 30 Min., A.C. |
| Average | 75.1 | 104.8 | .717 | 26.5 | |

TABLE VI

MECHANICAL PROPERTIES OF WELDED AND NORMALIZED CHROMIUM STEEL (HEAT 4423927, 0.380-INCH WALL THICKNESS)

| Sample No. | Yield Strength, ksi | Ultimate Tensile Strength, ksi | Y.S. U.T.S. | Elongation, % in 2 in. | Heat Treatment |
|---|---|---|---|---|---|
| C5-380-11 | 65.0 | 90.0 | | 24.5 | As-Welded |
| C5-380-12 | 66.4 | 90.3 | | 23.5 | As-Welded |
| Average | 65.7 | 90.2 | .728 | 24.0 | |
| C5-380-1 | 46.6 | 89.5 | | 27.5 | Normalized 1350 F for 30 Min., A.C. |
| C5-380-2 | 46.6 | 87.6 | | 29.5 | Normalized 1350 F for 30 Min., A.C. |
| Average | 46.6 | 88.6 | .526 | 28.5 | |
| C5-380-3 | 53.9 | 96.6 | | 28.0 | Normalized 1450 F for 30 Min., A.C. |
| C5-380-4 | 51.2 | 93.9 | | 29.0 | Normalized 1450 F for 30 Min., A.C. |
| Average | 52.6 | 95.3 | .552 | 28.5 | |
| C5-380-5 | 61.7 | 97.5 | | 27.0 | Normalized 1550 F for 30 Min., A.C. |
| C5-380-6 | 59.1 | 98.6 | | 28.0 | Normalized 1550 F for 30 Min., A.C. |
| Average | 60.4 | 98.1 | .616 | 27.5 | |
| C5-380-7 | 61.1 | 102.0 | | 26.0 | Normalized 1650 F for 30 Min., A.C. |
| C5-380-8 | 58.8 | 100.2 | | 26.0 | Normalized 1650 F for 30 Min., A.C. |
| Average | 60.0 | 101.1 | .593 | 26.0 | |
| C5-380-9 | 72.6 | 114.6 | | 21.0 | Normalized 1750 F for 30 Min., A.C. |
| C5-380-10 | 74.4 | 115.7 | | 19.5 | Normalized 1750 F for 30 Min., A.C. |

TABLE VI-continued

MECHANICAL PROPERTIES OF WELDED AND NORMALIZED CHROMIUM STEEL (HEAT 4423927, 0.380-INCH WALL THICKNESS)

| Sample No. | Yield Strength, ksi | Ultimate Tensile Strength, ksi | Y.S. U.T.S. | Elongation, % in 2 in. | Heat Treatment |
|---|---|---|---|---|---|
| Average | 73.5 | 115.2 | .638 | 20.3 | |

TABLE VII

MECHANICAL PROPERTIES OF WELDED AND NORMALIZED CHROMIUM STEEL (HEAT 4423927, 0.480-INCH WALL THICKNESS)

| Sample No. | Yield Strength, ksi | Ultimate Tensile Strength, ksi | Y.S. U.T.S. | Elongation, % in 2 in. | Heat Treatment |
|---|---|---|---|---|---|
| C4-480-11 | 67.7 | 89.5 | | 23.0 | As-Welded |
| C4-480-12 | 69.0 | 90.4 | | 22.0 | As-Welded |
| Average | 68.4 | 90.0 | .760 | 22.5 | |
| C4-480-1 | 48.7 | 91.2 | | 28.0 | Normalized 1350 F for 30 Min., A.C. |
| C4-480-2 | 47.8 | 90.4 | | 27.5 | Normalized 1350 F for 30 Min., A.C. |
| Average | 48.3 | 90.8 | .532 | 27.8 | |
| C4-480-3 | 56.0 | 95.5 | | 28.5 | Normalized 1450 F for 30 Min., A.C. |
| C4-480-4 | 55.6 | 95.3 | | 28.5 | Normalized 1450 F for 30 Min., A.C. |
| Average | 55.8 | 95.4 | .585 | 28.5 | |
| C4-480-5 | 62.5 | 98.7 | | 28.0 | Normalized 1550 F for 30 Min., A.C. |
| C4-480-6 | 63.2 | 99.9 | | 27.0 | Normalized 1550 F for 30 Min., A.C. |
| Average | 62.9 | 99.3 | .633 | 27.5 | |
| C4-480-7 | 62.6 | 103.9 | | 24.5 | Normalized 1650 F for 30 Min., A.C. |
| C4-480-8 | 61.4 | 101.4 | | 26.0 | Normalized 1650 F for 30 Min., A.C. |
| Average | 62.0 | 102.2 | .607 | 25.3 | |
| C4-480-9 | 73.3 | 116.8 | | 20.0 | Normalized 1750 F for 30 Min., A.C. |
| C4-480-10 | 72.4 | 116.9 | | 20.0 | Normalized 1750 F for 30 Min., A.C. |
| Average | 72.9 | 116.9 | .624 | 20.0 | |

As shown in Table II and FIG. 1, the minimum ultimate tensile strength requirement of 95 ksi can only be achieved in the basic carbon-manganese steel casing processed in a wall section of 0.380 inches when normalized at temperatures above 1550° F. When the same steel was processed in a 0.480 inch wall section (Table III and FIG. 2), the minimum 95 ksi strength level was not achieved at any normalizing temperature. It will also be seen that the yield strength at the 0.480 inch wall section was below the desired 55 ksi minimum when normalized at the temperatures of 1350° F. and 1450° F.

Microstructural changes were observed in the carbon-manganese steel with increasing normalizing temperatures. At the lowest temperature (1350° F.), the microstructure consisted of degenerate pearlite with considerable banding. At a higher normalizing temperature (1550° F.), the microstructure appeared to be less banded and consisted of degenerate and very fine pearlite. At the highest normalizing temperature studied (1750° F.), the microstructure consisted of large patches of fine pearlite with the amount of banding being drastically reduced.

Figure 6:
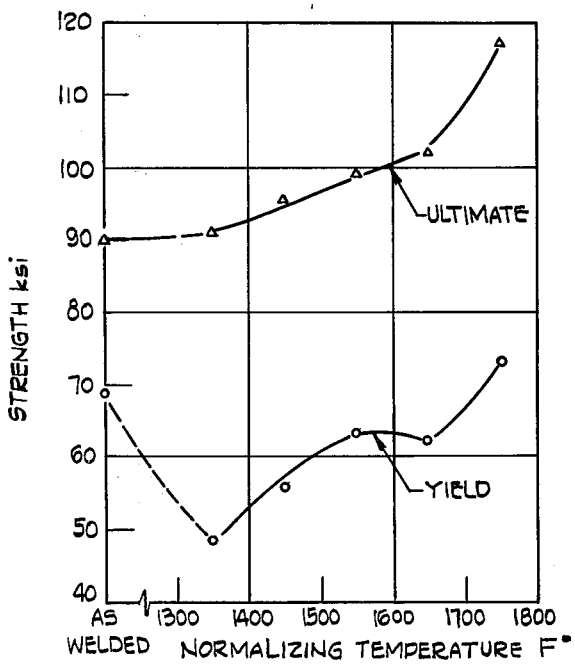

The test results of the vanadium-containing steel casing of both wall thicknesses are represented in Tables IV and V and by FIGS. 6 and 7. The data shows that it was necessary to normalize the 0.380 inch wall section at or greater than 1550° F. in order consistently to meet the minimum strength requirements, and that it was necessary to normalize the 0.480 inch wall section at or above 1650° F.

The microstructural changes observed in the vanadium steel at different normalizing temperatures was similar to the changes observed in the carbon-manganese steel with the exception of slightly less banding.

Figure 5:
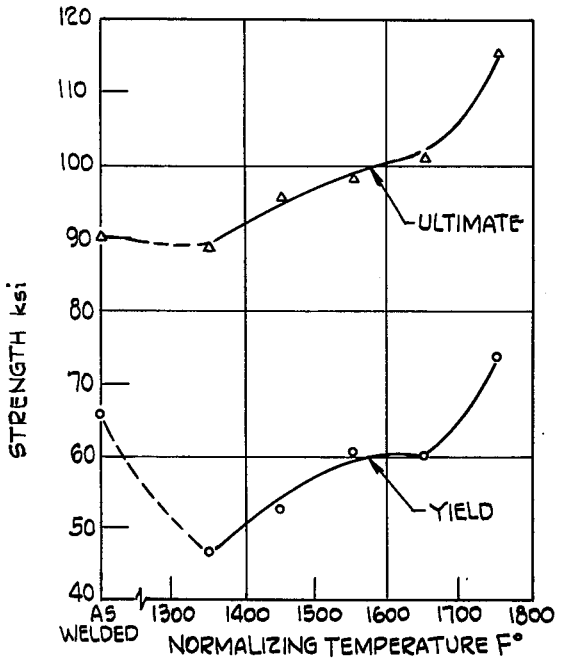
FIGS. 5 and 6 are graphs showing the yield and ultimate tensile strengths of a chromium alloyed steel casing according to the present invention of two different wall sections normalized at varying temperatures.

The test results obtained from the chromium steel casing of both wall thicknesses are presented in Tables VI and VII and FIGS. 5 and 6. These results show that at a normalizing temperature as low as 1450° F., the ultimate tensile strength exceeded the minimum level of 95 ksi in both wall sections. The yield strength to ultimate tensile strength ratio was less than both the carbon-manganese steel and the vanadium alloyed steel, however, the desired 55 ksi minimum yield strength can be obtained by normalizing as low as 1550° and 1450° F. in the case of the 0.380 and 0.480 inch wall section pipe, respectively, Another significant feature indicated by the foregoing results is that the chromium steel casing of the invention was the most consistent in meeting and surpassing the ultimate tensile strength requirement of 95 ksi. With the carbon-manganese and vanadium alloyed steel casings, the minimum strength level was barely achieved by normalizing at high temperatures. With the chromium alloyed steel of the invention, a high normalizing temperature of 1750° F. could be used to produce an ultimate tensile strength far in excess of the minimum of 95 ksi level. This advantage provides a safety margin with respect to mechanical properties and affords greater leeway in normalizing temperature variations.

Microstructural studies on the chromium steel revealed differences in the microstructure produced by normalizing as compared to the carbon-manganese and vanadium steels. Whereas the latter two steels were associated with ferrite-pearlite microstructures, the chromium steel contained quantities of acicular structure believed to be bainite. This structure is believed to be responsible for the substantial and unexpected increases in tensile strength properties for the steel of the invention.

Many modifications and variations of the invention will be apparent to those skilled in the art in light of the foregoing disclosure. Therefore, it is to be understood that, within the scope of the appended claims, the invention can be practised otherwise than as specifically shown and described.

What is claimed is:

1. A rolled and normalized welded tubular product formed of a steel consisting essentially of the following elements in amounts by weight based on the total weight of the steel: from 0.20 to 0.40% carbon, from 1.00 to 1.75% manganese, from 0.15 to 0.50% silicon, from 0.20 to 1.00% chromium, from 0.01 to 0.05% aluminum and the balance iron except for normal residual constituents, said steel being further characterized by a yield strength of from about 55 to 80 ksi and an ultimate tensile strength of at least about 95 ksi.

2. A rolled and normalized welded tubular product formed of a steel consisting essentially of the following elements in amounts by weight based on the total weight of the steel: from 0.25 to 0.30% carbon, from 1.25 to 1.50% manganese, from 0.20 to 0.35% silicon, from 0.40 to 0.60% chromium, from 0.01 to 0.05% aluminum and the balance iron except for normal residual constituents, said steel being further characterized by a yield strength of from about 55 to 80 ksi and an ultimate tensile strength of at least about 95 ksi.

* * * * *